US005347209A

United States Patent [19]

Payne et al.

[11] Patent Number: 5,347,209

[45] Date of Patent: Sep. 13, 1994

[54] VOLTAGE CONTROL IN PULSED SYSTEM BY PREDICT-AHEAD CONTROL

[75] Inventors: Anthony N. Payne, San Lorenzo; James A. Watson, Tracy; Stephen E. Sampayan, Manteca, all of Calif.

[73] Assignee: The United States of America as represented by the United States Department of Energy, Washington, D.C.

[21] Appl. No.: 933,154

[22] Filed: Aug. 21, 1992

[51] Int. Cl.[5] ..... G05F 1/46

[52] U.S. Cl. ..... 323/271; 323/285; 323/288; 323/292; 363/124

[58] Field of Search ..... 323/266, 268, 271, 282, 323/285, 288, 291, 292; 363/124

[56] References Cited

U.S. PATENT DOCUMENTS

| | | | |
|---|---|---|---|
| 3,675,116 | 7/1972 | Israel | 323/271 |
| 4,405,889 | 9/1983 | Overstreet et al. | 323/282 |
| 4,803,378 | 2/1989 | Richardson | 323/282 |
| 5,184,085 | 2/1993 | Nakajima | 328/65 |

OTHER PUBLICATIONS

Newton et al., "Timing and Voltage Control of Magnetic Modulators on ETA II"; Jun. 1989; IEEE Power Conf.; pp. 175–177.

*Primary Examiner*—Jeffrey L. Sterrett

*Attorney, Agent, or Firm*—Miguel A. Valdes; Roger S. Gaither; William R. Moser

[57] ABSTRACT

A method and apparatus for predict-ahead pulse-to-pulse voltage control in a pulsed power supply system is disclosed. A DC power supply network is coupled to a resonant charging network via a first switch. The resonant charging network is coupled at a node to a storage capacitor. An output load is coupled to the storage capacitor via a second switch. A de-Q-ing network is coupled to the resonant charging network via a third switch. The trigger for the third switch is a derived function of the initial voltage of the power supply network, the initial voltage of the storage capacitor, and the present voltage of the storage capacitor. A first trigger closes the first switch and charges the capacitor. The third trigger is asserted according to the derived function to close the third switch. When the third switch is closed, the first switch opens and voltage on the node is regulated. The second trigger may be thereafter asserted to discharge the capacitor into the output load.

13 Claims, 3 Drawing Sheets

VOLTAGE CONTROL IN PULSED SYSTEM BY PREDICT-AHEAD CONTROL

The United States Government has rights in this invention pursuant to Contract No. W-7405-ENG-48 between the United States Department of Energy and the University of California for the operation of Lawrence Livermore National Laboratory.

BACKGROUND

The present invention relates to voltage control in pulsed power systems, and more particularly, to a predict-ahead controller for achieving increased pulse-to-pulse stability in pulsed power systems and especially those that use command-resonant-charge (CRC) architecture.

CRC architecture is typically used in pulsed systems to transfer energy from one capacitor bank to a second capacitor bank of lower capacity to achieve voltage gain. CRC architecture is common in devices which power Linear Induction Accelerators (LIA's), RADAR systems, EMP simulators, accelerator power sources, and Laser Isotope Separator (LIS) systems.

LIA's are used to produce high average power charged particle beams. These accelerators have been operated at high current (greater than 1 kA), moderate energy (on the order of tens of MeV), and at high repetition rates (on the order of 5 KHz). Operation of the LIA depends on the time rate of change of magnetic flux through the magnetic material (typically ferrite) within the accelerator cells. The changing flux produces an acceleration gradient along the accelerator axis that imparts energy to the charged particle beam.

Pulse-to-pulse voltage stability is fundamental to the high power operation of a Free Electron Laser (FEL) driven by an LIA. Such technology is being used to heat plasmas using electron cyclotron resonance heating (ECRH). Magnetic modulators, which use nonlinear, voltage dependent magnetics, are also among the devices which require a stable voltage source for stable pulse-to-pulse timing control and voltage regulation.

LIA technology has been proposed for hazardous waste treatment, product sterilization, and X-ray lithography. The success of these concepts depends in part upon stable operation of the LIA, which requires exceptional pulse-to-pulse voltage stability in the accelerator pulsed-power system.

Industrial applications of CRC architecture include high frequency annealing, E-beam and conventional welding, and magneforming. Pulse-to-pulse voltage stability in these systems can lead to better quality control. CRC architecture is also used in the medical industry. Applications include RF heating (diathermy), X-ray systems, and magnetic resonance imaging (MRI) systems. Pulse-to-pulse voltage stability in these systems can potentially improve instrument accuracy as well as patient safety.

SUMMARY OF THE INVENTION

A method and apparatus for predict-ahead voltage control for pulsed power supply systems is disclosed. A DC power supply network, including a charging capacitor, is coupled to a resonant charging network via a first switch. The resonant charging network is coupled to an Intermediate Energy Storage (IES) capacitor. An output load is coupled to the IES capacitor via a second switch. A de-Q-ing network is coupled to the resonant charging network via a third switch.

The first, second, and third switches are triggered by first, second, and third trigger pulses, respectively. The timing of the third trigger pulse is determined from a prediction $V_2^*(t)$ of $V_2(t+\Delta)$ as a function of the initial voltage $V_1(0)$ of the power supply network, the initial voltage $V_2(0)$ of the IES capacitor, and the present voltage $V2(t)$ of the IES capacitor. Preferably, $V_2^*(t)=V'_2(t)+(K_5 dV'_2(t)/dt)^2$, where $V'_2(t)=K_1V_2(t)+K_2dV_2(t)/dt+K_3V_1(0)+K_4V_2(0)$, where $K_1=\cos\omega\delta_1$, $K_2=(\sin\omega\delta_1)/\omega$, $K_3=C_1(1-\cos\omega\delta_1)/(C_1+C_2)$, $K_4=C_2(1-\cos\omega\delta_1)/(C_1+C_2)$, $K_5=\sqrt{C_2/2\alpha}$, and $\omega=1/\sqrt{LC}$ where $C=C_1C_2/(C_1+C_2)$.

A better understanding of the features and advantages of the present invention will be obtained by reference to the following detailed description of the invention and accompanying drawings which set forth an illustrative embodiment in which the principles of the invention are utilized.

DETAILED DESCRIPTION OF THE INVENTION

Figure 1:
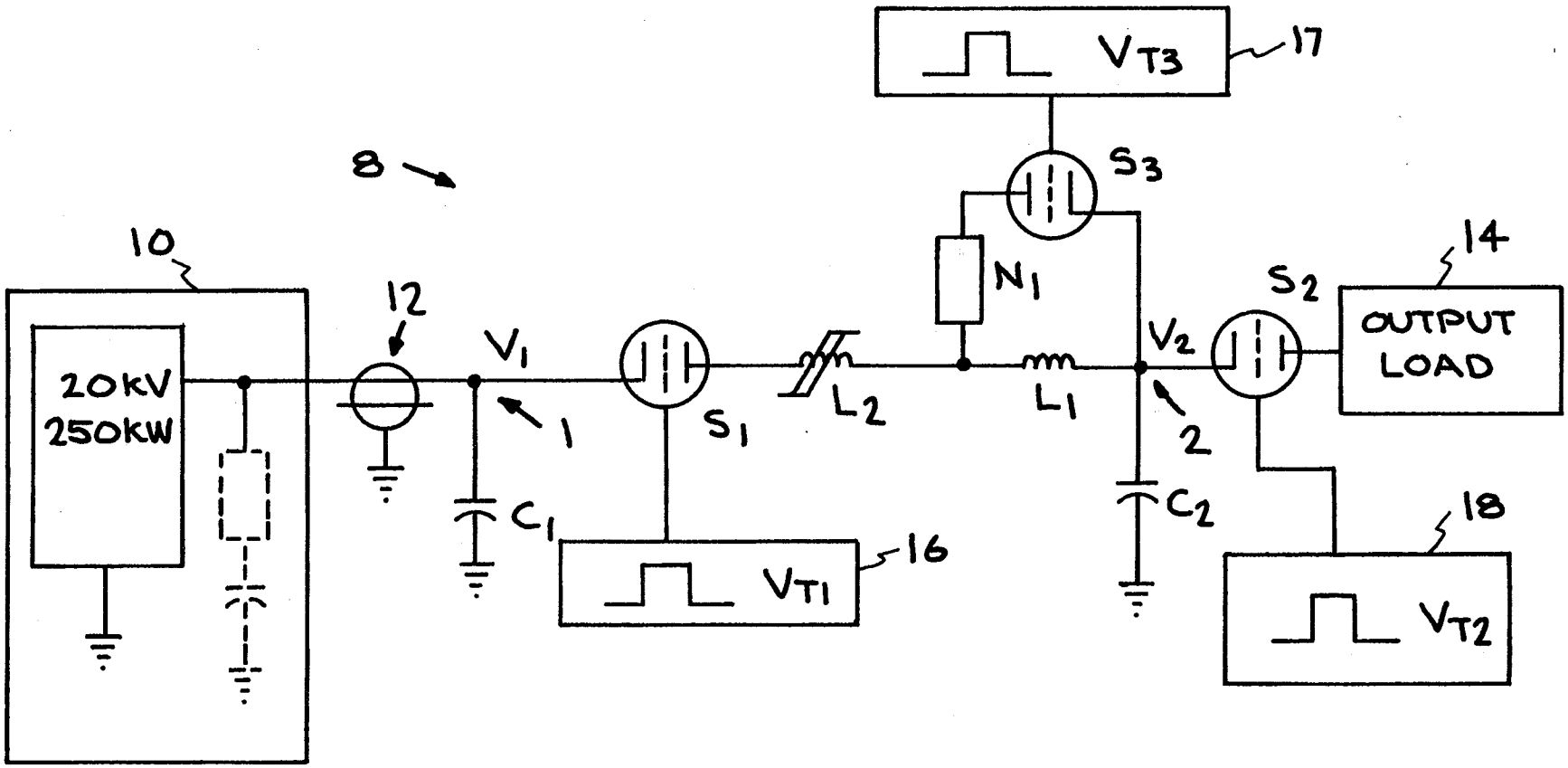
FIG. 1 is a schematic circuit diagram of a pulsed power unit according to the present invention.

FIG. 1 depicts a simplified schematic diagram of a pulsed power supply system 8. The described embodiment is capable of supplying a 25 kV, 20 kA, 4 μS output pulse at a 5 kHz repetition rate.

An unregulated DC power supply 10 provides 20 kV, 250 kW of primary power. In a typical configuration, twenty 50 μF capacitors provide energy storage capacity. The power supply 10 is coupled by a shielded cable 12 to the cathode of a first thyratron switch $S_1$ at node 1. The anode of thyratron $S_1$ is coupled to one terminal of inductor $L_2$- The other terminal of inductor $L_2$ is coupled to one terminal of inductor $L_1$ and to one terminal of network $N_1$. The other terminal of inductor $L_1$ is coupled to one terminal of capacitor $C_2$, to the cathode of thyratron $S_2$, and to the cathode of thyratron $S_3$ at node 2. The anode of thyratron $S_3$ is coupled to the other terminal of network $N_1$. The inductor $L_2$ is biased into a saturation state by a biasing network (not shown). The anode of thyratron switch $S_2$ is coupled to an output load 14.

The thyratron switches $S_1$, $S_2$, and $S_3$ are closed by supplying a current to respective grids of the thyratron switches in the form of trigger pulses $V_{T1}$, $V_{T2}$, and $V_{T3}$, respectively. The trigger pulses $V_{T1}$, $V_{T2}$, and $V_{T3}$ are generated by individual trigger generators 16, 17, 18.

When inductor $L_2$ is in a saturated state, it has a very low inductance for forward current, but a large inductance for reverse current. Thus, immediate reverse voltage is developed across the inductor $L_2$ rather than across the thyratron tube $S_1$, thereby providing time for the tube to recover between pulses.

The basic operation of the circuit will now be described. The thyratron switch $S_1$ closes when trigger pulse $V_{T1}$ is applied to the grid of thyratron $S_1$, thereby resonantly charging capacitor $C_2$ through inductor $L_1$. Capacitor $C_2$ is also called the Intermediate Energy Storage (IES) capacitor. Ideally, the charging voltage $V_2(t)$ across the IES capacitor $C_2$ (in the absence of losses) is given by:

$$V_2(t) = V_2(0) + \frac{C_1}{C_1 + C_2}[V_1(0) - V_2(0)](1 - \cos\omega t) \quad (1)$$

where $V_1(0)$ and $V_2(0)$ are the initial voltages at nodes 1 and 2, respectively, at the moment when switch $S_1$ closes, namely $t=0$; and $\omega=1/\sqrt{LC}$, where $C=C_1C_2/(C_1+C_2)$, L is the total inductance of the charging loop, and $0 \leqq \omega t \leqq \pi$. For the described embodiment, $\omega=2.88\times10^4$ seconds$^{-1}$, $C_1=20$ $\mu$F, $C_2=2$ $\mu$F. Ideally, the IES capacitor $C_2$ will charge to a peak value of approximately 1.8 $V_1(0)$, according to equation (1), provided switch $S_1$ remains closed and $V_2(0)=0$. At this peak value, current flow reaches zero and begins to reverse. Simultaneously, $L_2$ transitions from a saturated, low inductance state to an unsaturated, high inductance state. While in the high inductance state, sufficient delay is provided at the zero current to allow the thyratron switch $S_1$ to cease conduction and open. Thus, in the absence of losses, $V_2$ remains approximately 1.8 $V_1(0)$.

Even with some means for voltage control at node 1, the initial voltage $V_1(0)$ on the charging capacitor $C_1$ may vary sufficiently to prevent a high degree of regulation at the output of the pulsed power system 8. Alternatively, absent some means of voltage control at node 1, and, as is typically done in a short burst system, use of a "trickle" low power DC power supply to charge the large power supply capacitors, the initial voltage $V_1(0)$ on the charging capacitor $C_1$ may vary as much as twenty to thirty percent.

Regulation of the voltage at node 2 is accomplished through the thyratron $S_3$ and the network $N_1$. The network $N_1$ is a "de-Q-ing" network, and a complete description thereof can be found in the article "Timing and Voltage Control of Magnetic Modulators on ETA II" by M. A. Newton and J. A. Watson, Digest of Technical Papers, Seventh IEEE Pulsed Power Conference, June 1989, pp. 175–77.

A trigger pulse $V_{T3}$ is applied to the grid of thyratron switch $S_3$ thereby closing the switch, and thyratron switch $S_1$ becomes reverse biased. Thyratron switch $S_1$ subsequently opens, thereby stopping the flow of charging current and maintaining $V_2$ at the desired voltage level.

Thus, it can be appreciated that the proper timing of the trigger pulse $V_{T3}$ for switch $S_3$ is crucial for obtaining accurate voltage regulation at node 2.

The trigger pulse $V_{T3}$ must be timed to account for inherent system delays, such as the delay in the trigger pulse amplifier, the hysteresis of the voltage comparator, the turn-on time of thyratron $S_3$, and the turn-off time of thyratron $S_1$. In the described embodiment, these delays are constant.

Therefore, the present invention discloses a controller for generating the trigger pulse of thyratron $S_3$ that predicts the IES capacitor voltage at some future time $t+\Delta$, where $\Delta$ is the total inherent system delay between the time t when a command is issued to trigger switch $S_3$ and the time $t+\Delta$ when the charging current through $L_1$ actually ceases to flow. The total delay $\Delta$ is equal to $\delta_1+\delta_2$, where $\delta_1$ is the delay between the assertion of trigger pulse $V_{T1}$ and the closing of switch $S_3$, and $\delta_2$ is the delay between the closing of switch $S_3$ and the opening of switch $S_1$.

It can been shown that a good prediction for $V_2*(t)$ is given by:

$$V_2(t+\Delta) \approx V_2^*(t) = V'_2(t) + (K_5 dV'_2(t)/dt)^2 \quad (2)$$

where $V'_2(t)$ is given by:

$$V'_2(t) = K_1V_2(t) + K_2dV_2(t)/dt + K_3V_1(0) + K_4V_2(0) \quad (3)$$

where $K_1=\cos\delta_1$ $K_2=(\sin\omega\delta_1)/\omega$ $K_3=C_1(1-\cos\omega\delta_1)/(C_1+C_2)$ $K_4=C_2(1-\cos\omega\delta_1)/(C_1+C_2)$ $K_5=\sqrt{C_2/2\alpha}$ $\omega=1/\sqrt{LC}$ $C=C_1C_2/(C_1+C_2)$.

where $\alpha$ is the approximate magnitude of the charging current during the time interval from $(t+\delta)$ to $(t+\Delta)$. Therefore, the command to issue the trigger pulse $V_{T3}$ for switch $S_3$ is issued at the time $t=T$ at which $V_2*(T)$ equals the desired IES voltage.

It can be appreciated that expressions having greater or fewer terms than equations (2) and (3) can be derived which may provide varying degrees of accuracy. For example, we have published an article describing the present invention with a three term solution. See "Precision Voltage Regulation on the 5 KHz 3.125 mW ETA-II Pulsed Power System" by J. A. Watson, A. N. Payne, S. E. Sampayan and C. W. Ollis, Digest of Technical Papers, Eighth IEEE Pulsed Power Conference, June 1991, pp. 221–223.

Figure 2A:
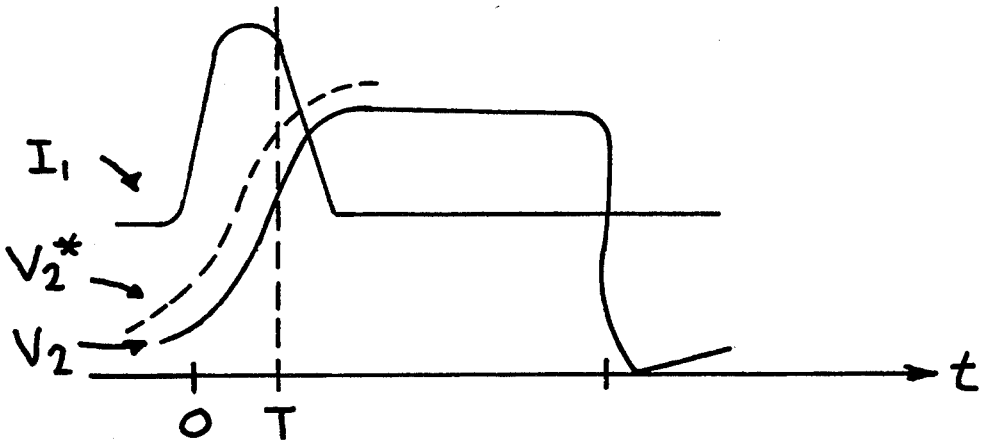
FIG. 2*a* is a graphical plot of circuit conditions in FIG. 1, namely charging current at node 1, predicted voltage at node 2, and actual voltage at node 2, said voltages being inverted for convenient illustration.
Figure 2B:
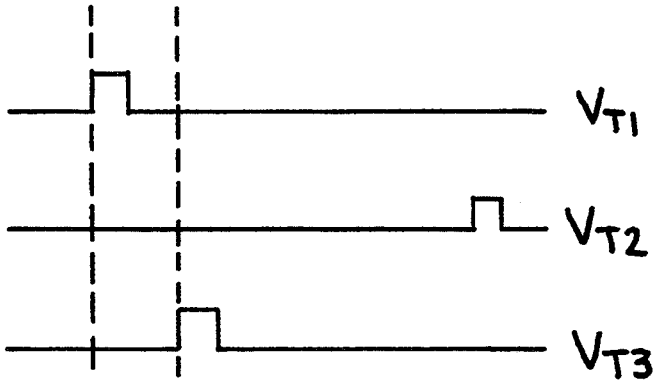
FIG. 2*b* is a timing diagram illustrating the assertion of trigger pulses for the thyratron switches.

The net effect of the present invention is illustrated in FIGS. 2*a* and 2*b*. At time $t=0$, the first trigger pulse $V_{T1}$ is asserted, thereby closing thyratron switch $S_1$. The charging capacitor $C_1$ then discharges a charging current $I_1$ to the IES capacitor $C_2$. At time $t=T$, the predicted voltage $V_2*$, shown as a dotted line in FIG. 2*a*, reaches the desired "predict-ahead" voltage at node 2, and the third trigger pulse $V_{T3}$ is initiated, thereby closing thyratron switch $S_3$. This causes switch $S_1$ to become reverse-biased, thereby stopping the flow of charging current $I_1$ and allowing the de-Q-ing network to regulate the voltage $V_2$ at node 2 at the desired level. At some later time, trigger pulse $V_{T2}$ can be initiated to allow the IES voltage $V_2$ at node 2 to be discharged to the output load 14.

Figure 3:
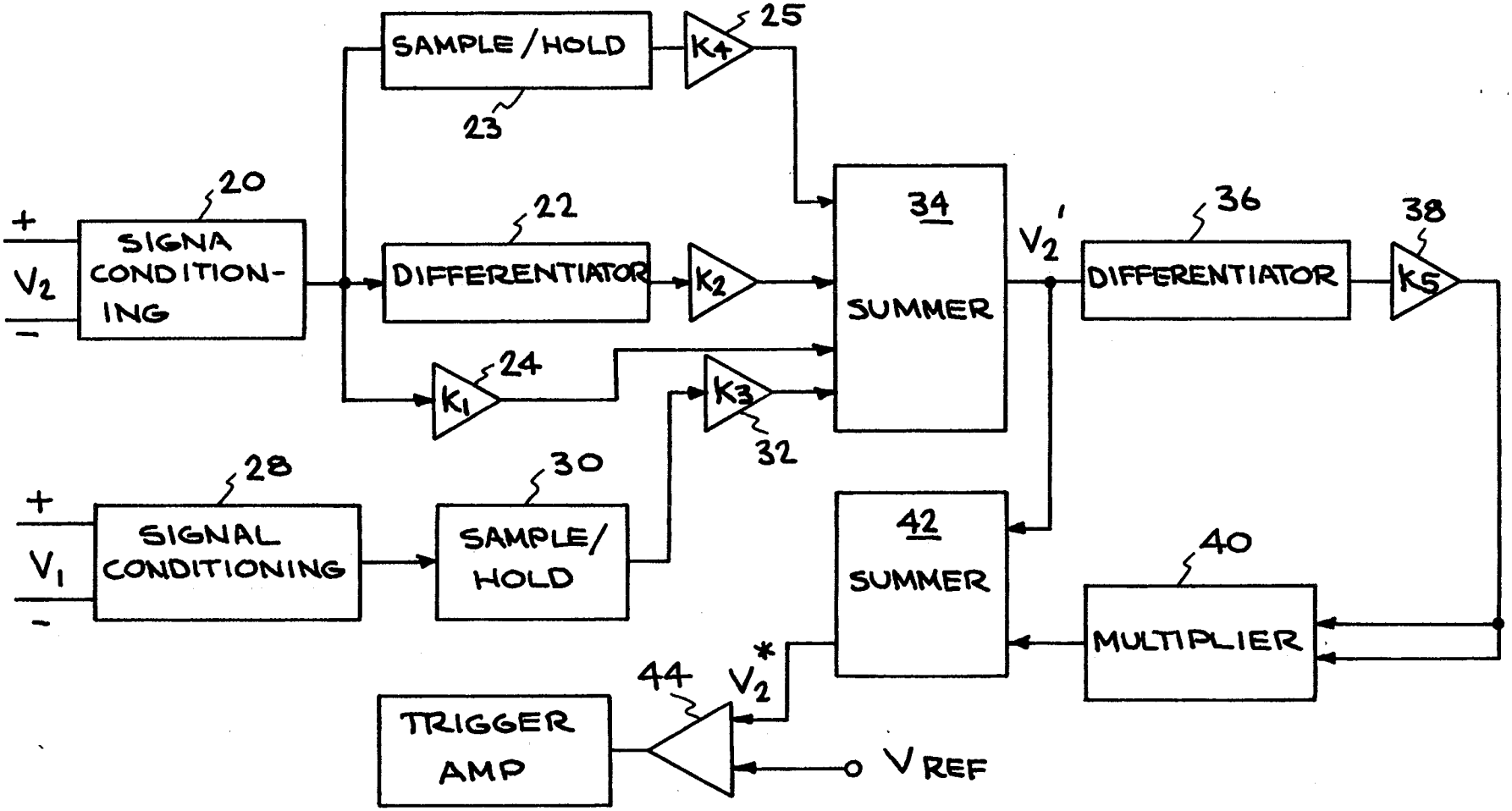
FIG. 3 is a block diagram of an analog computer implementation of the trigger pulse generator according to the present invention.

A circuit to implement Equations (2) and (3) is easily realized as illustrated in the block diagram of FIG. 3. The voltage $V_2$ at node 2 is coupled to signal conditioning network 20. The signal conditioning network 20 scales down the input signal to facilitate handling by conventional signal processing circuitry. The output of the signal conditioning network 20 is then passed in parallel through a differentiator network 22, a sample/hold network 23, and a first amplifier 24. The first amplifier has a gain constant $K_1$ as described above. The differentiator network 22 generates an output signal which is the time derivative of the voltage function for $V_2(t)$, which is then passed through a second amplifier 26. The second amplifier has a gain constant $K_2$ as described above. The sample/hold network 23 samples the input when the trigger pulse $V_{T1}$ is asserted and provides the signal to amplifier 25. The amplifier 25 has a gain constant $K_4$ as described above.

The voltage $V_1$ at node 1 is coupled to a second signal conditioning network 28 which scales down the input signal to facilitate handling by conventional signal processing circuitry. The signal is then passed through a sample/hold network 30, where the signal is sampled at the time that trigger pulse $V_{T1}$ is asserted. The signal is then amplified with gain constant $K_3$ through a third amplifier 32. The gain constant $K_3$ is described above.

The outputs of amplifiers 24, 25, 26, and 32 are coupled to a summer 34 where the signals are summed. The output of the summer 34 is $V'_2(t)$. This signal is coupled to differentiator 36, where the time derivative of the voltage function for $V'_2(t)$ is obtained. The differentiated signal is then passed through amplifier 38, which has a gain constant $K_5$ as described above. Next, the signal is multiplied by itself in multiplier 40 in order to realize the square function of equation (2). Finally, a summer 42 adds the signal back to $V'_2$, and the resultant output $V_2^*(t)$ accurately approximates the predicted voltage $V_2(t+\Delta)$. The output is compared to a reference voltage $V_{ref}$ by comparator 44. When the output of summer 42 is equal to $V_{ref}$, trigger amplifier 46 generates the trigger pulse $V_{T3}$.

The specific details for realization of the blocks illustrated in FIG. 3 are well known to one with ordinary skill in analog circuit design and are therefore not provided herein. Further, it should be clear that FIG. 3 may be implemented numerically by utilization of a fast digital computer.

It should be understood that the invention is not intended to be limited by the specifics of the above-described embodiment, but rather defined by the accompanying claims.

We claim:

1. A method for regulating the voltage V(t) at a node in a circuit, wherein the voltage V(t) is a voltage waveform having a predictable shape that is a function of the time response of the circuit components, and wherein the node has a regulation circuit coupled thereto by a switch, said switch being closed by asserting a trigger pulse, the method comprising predicting the node voltage $V(t+\Delta)$ at a future time $t+\Delta$ where $\Delta$ is equal to the amount of time delay between asserting the trigger pulse and actual switch closure, and asserting the trigger pulse when the prediction of the future voltage $V(t+\Delta)$ equals the desired node voltage.

2. A method for regulating voltage in a pulsed power system having a resonant charging network coupled to a storage capacitor, a DC power supply network coupled to the resonant charging network via a first switch, an output load coupled to the storage capacitor via a second switch, and a de-Q-ing network coupled to the resonant charging network via a third switch, the first, second and third switches being triggered by a first trigger pulse, a second trigger pulse, and a third trigger pulse, respectively, the method comprising generating said third trigger pulse at a time that is a function of an initial voltage $V_1(0)$ of the power supply network and a present voltage $V_2(t)$ of the capacitor.

3. A method according to claim 2, wherein the time for generating the third trigger pulse is also a function of an initial voltage $V_2(0)$ of the capacitor.

4. In a pulsed power system having a resonant charging network coupled to a storage capacitor, a DC power supply network coupled to the resonant charging network via a first switch, an output load coupled to the storage capacitor via a second switch, and a de-Q-ing network coupled to the resonant charging network via a third switch, the first, second and third switches being triggered by a first trigger pulse, a second trigger pulse, and a third trigger pulse, respectively, the improvement comprising means for generating said third trigger pulse at a time that is a function of an initial voltage $V_1(0)$ of the power supply network and a present voltage $V_2(t)$ of the capacitor.

5. A pulsed power system according to claim 4, wherein the time for generating the third trigger pulse is also a function of an initial voltage $V_2(0)$ of the capacitor.

6. A pulsed power supply system, comprising:

DC power supply means for providing DC power to a first node;

means for storing energy;

a resonant charging network coupled to the energy storage means at a second node;

a first switch coupled between the DC power supply means and the resonant charging network, said first switch being triggered by a first trigger pulse;

means for generating the first trigger pulse;

an output load;

a second switch coupled between the energy storage means and the output load, said second switch being triggered by a second trigger pulse;

means for generating the second trigger pulse;

a de-Q-ing network; and a third switch coupled between the second node and the de-Q-ing network, said third switch being triggered by a third trigger pulse at a time that is determined as a function of an initial voltage $V_1(0)$ at the first node and a present voltage $V_2(t)$ at the second node, wherein the initial voltage $V_1(0)$ is measured at the time when the first trigger pulse is asserted;

means for generating the third trigger pulse, wherein asserting the first trigger pulse closes the first switch and allows the resonant charging network to charge the energy storage means, said third trigger pulse thereafter being asserted to close the third switch and open the first switch to regulate the voltage at the second node, said second trigger pulse thereafter being asserted to close the second switch and discharge the energy storage means into the output load.

7. A pulsed power supply system according to claim 6, wherein the time at which the third switch is triggered by the third trigger pulse is also a function of an initial voltage $V_2(0)$ of the capacitor.

8. A pulsed power supply system according to claim 6, wherein the DC power supply means comprises a first capacitor $C_1$ and the energy storage means comprises a second capacitor $C_2$, and wherein the timing of the third trigger pulse is determined from a prediction $V'_2(t)$ of the voltage at the second node at a future time $t+\Delta$ wherein the prediction $V'_2(t)=K_1V_2(t)+K_2dV_2(t)/dt+K_3V_1(0)$, where $K_1=\cos\ \omega\delta_1$, $K_2=(\sin\ \omega\delta_1)/\omega$, $K_3=C_1(1-\cos\ \omega\delta_1)/(C_1+C_2)$, and $\omega=1/\sqrt{LC}$ where $C=C_1C_2/(C_1+C_2)$.

9. A pulsed power supply system according to claim 6, wherein the DC power supply means comprises a first capacitor $C_1$ and the energy storage means comprises a second capacitor $C_2$, and wherein the timing of the third trigger pulse is determined from a prediction $V_2^*(t)$ of the voltage at the second node at a future time $t+\Delta$, wherein the prediction $V_2^*(t)=V'_2(t)+(K_5 dV'_2(t)/dt)^2$, where $V'_2(t)=K_1V_2(t)+K_2dV_2(t)/dt+K_3V_1(0)+K_4V_2(0)$, where $K_1=\cos\omega\delta_1$, $K_2=(\sin\omega\delta_1)/\omega$, $K_3=C_1(1-\cos\omega\delta_1)/(C_1+C_2)$, $K_4=C_2(1-\cos\omega\delta_1)/(C_1+C_2)$, $K_5=\sqrt{C_2/2\alpha}$, and $\omega=1/\sqrt{LC}$ where $C=C_1C_2/(C_1+C_2)$.

10. A pulsed power supply system according to claim 6, wherein the means for generating the third trigger pulse realizes the function $V'_2(t)=K_1V_2(t)+K_2dV_2(t)/dt+K_3V_1(0)$, where $V'_2(t)$ is a prediction of the voltage at the second node at a future time $t+\Delta$, $K_1=\cos\omega\delta_1$, $K_2=(\sin\omega\delta_1)/\omega$, $K_3=C_1(1-\cos\omega\delta_1)/(C_1+C_2)$, and $\omega=1/\sqrt{LC}$ where $C=C_1C_2/(C_1+C_2)$.

11. A pulsed power supply system according to claim 6, wherein the means for generating the third trigger pulse realizes the function $V_2^*(t)=V'_2(t)+(K_5dV'_2(t)/dt)^2$, where $V_2^*(t)$ is a prediction of the voltage at the second node at a future time $t+\Delta$, $V'_2(t)=K_1V_2(t)+K_2dV_2(t)/dt+K_3V_1(0)+K_4V_2(0)$, $K_1=\cos\omega\delta_1$, $K_2=(\sin\omega\delta_1)/\omega$, $K_3=C_1(1-\cos\omega\delta_1)/(C_1+C_2)$, $K_4=C_2(1-\cos\omega\delta_1)/(C_1+C_2)$, $K_5=\sqrt{C_2/2\alpha}$, and $\omega=1/\sqrt{LC}$ where $C=C_1C_2/(C_1+C_2)$.

12. A pulsed power supply system according to claim 6, wherein the means for generating the third trigger pulse comprises:

a first signal conditioning network coupled to the second node;

a first amplifier coupled to the first signal conditioning network;

a differentiator network coupled to the first signal conditioning network;

a second amplifier coupled to the differentiator network;

a second signal conditioning network coupled to the first node;

a sample/hold network coupled to the second signal conditioning network and initiated by the first trigger pulse;

a third amplifier coupled to the sample/hold network;

a summing network coupled to the first amplifier, to the second amplifier, and to the third amplifier;

a comparator coupled to the summing network and to a reference voltage for generating the third trigger pulse.

13. A pulsed power supply system according to claim 6, wherein the means for generating the third trigger pulse comprises:

a first signal conditioning network coupled to the second node;

a first amplifier coupled to the first signal conditioning network;

a first differentiator network coupled to the first signal conditioning network;

a first sample/hold network coupled to the first signal conditioning network and initiated by the first trigger pulse;

a second signal conditioning network coupled to the first node;

a second sample/hold network coupled to the second signal conditioning network and initiated by the first trigger pulse;

a second amplifier coupled to the first differentiator network;

a third amplifier coupled to the second sample/hold network;

a fourth amplifier coupled to the first sample/hold network;

a first summing network coupled to the first, second, third, and fourth amplifiers;

a second differentiator network coupled to the summer;

a fifth amplifier coupled to the second differentiator network;

a multiplier network coupled to the fifth amplifier;

a second summing network coupled to the first summing network and to the multiplier network; and a comparator coupled to the second summing network and to a reference voltage for generating the third trigger pulse.

* * * * *